US008528474B2

(12) United States Patent
Monteith

(10) Patent No.: US 8,528,474 B2
(45) Date of Patent: Sep. 10, 2013

(54) RECYCLING AND ACCESSORY STORAGE APPARATUS

(76) Inventor: Stuart Hamilton Monteith, Auckland (NZ)

( * ) Notice: Subject to any disclaimer, the term of this patent is extended or adjusted under 35 U.S.C. 154(b) by 388 days.

(21) Appl. No.: 12/882,548

(22) Filed: Sep. 15, 2010

(65) Prior Publication Data

US 2011/0061548 A1 Mar. 17, 2011

(30) Foreign Application Priority Data

Sep. 16, 2009 (NZ) ..... 579710

(51) Int. Cl.
*B30B 9/30* (2006.01)

(52) U.S. Cl.
USPC ..... 100/102; 100/233

(58) Field of Classification Search
USPC ..... 100/102, 225, 226, 233, 265, 902; 220/908, 909; 232/43.1, 43.2
See application file for complete search history.

(56) References Cited

U.S. PATENT DOCUMENTS

| | | | | | |
|---|---|---|---|---|---|
| 2,191,488 | A | * | 2/1940 | McCowan | 100/293 |
| 3,826,186 | A | * | 7/1974 | Mechler | 100/25 |
| 4,700,950 | A | * | 10/1987 | Gardner | 273/451 |
| 5,072,852 | A | * | 12/1991 | Smith et al. | 220/495.09 |
| 5,263,338 | A | * | 11/1993 | Banks | 62/331 |
| 5,440,978 | A | * | 8/1995 | O'Brien et al. | 100/99 |
| 5,456,166 | A | * | 10/1995 | Belongia et al. | 100/351 |
| 5,611,270 | A | | 3/1997 | Harrington | |
| 6,138,558 | A | * | 10/2000 | Harrington | 100/102 |

OTHER PUBLICATIONS

Examination Report for NZ dated Sep. 21, 2010; Examination Report for NZ and Acceptance dated Jan. 16, 2012.

* cited by examiner

*Primary Examiner* — Jimmy T Nguyen
(74) *Attorney, Agent, or Firm* — Young & Thompson

(57) ABSTRACT

A recycling and accessory storage apparatus for crushing items and storing accessory devices, includes a housing having apertures therein. At least one of the apertures is adapted to store an accessory and at least one other aperture is adapted to allow an item to be inserted, crushed and ejected out of the apparatus.

11 Claims, 9 Drawing Sheets

FIGURE

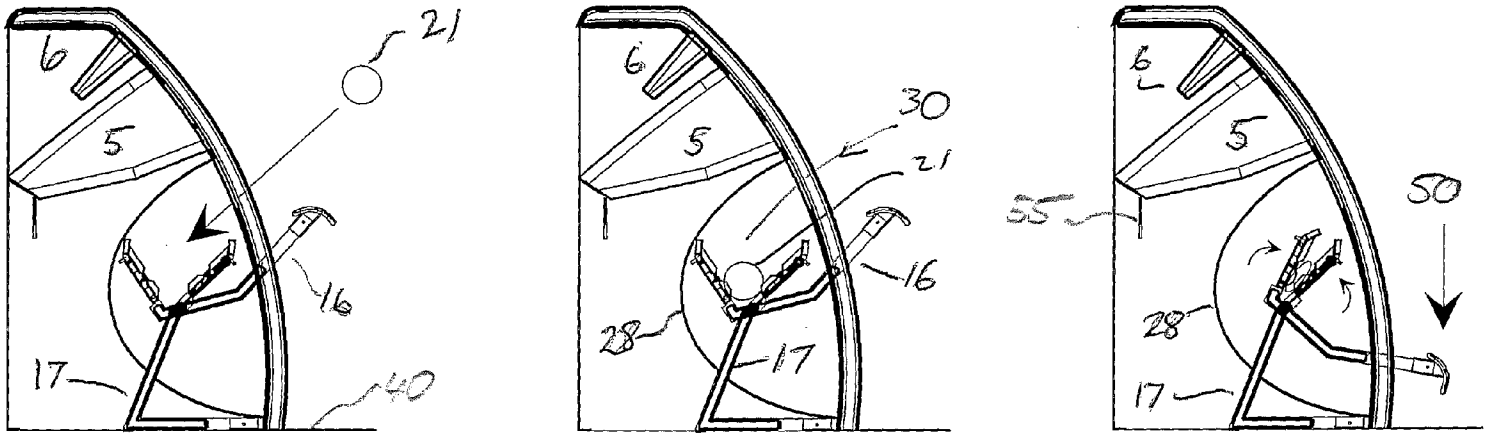
FIGURE 17
FIGURE 18
FIGURE 19
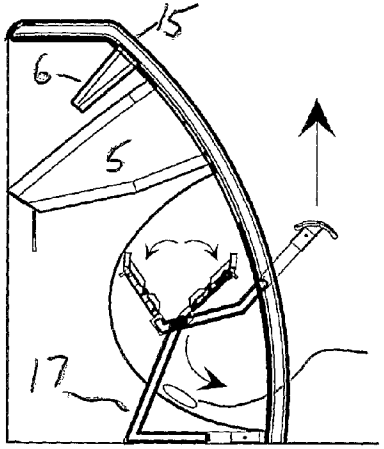
FIGURE 20
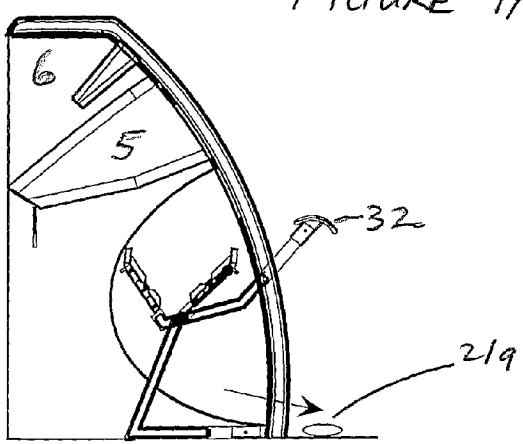
FIGURE 21

RECYCLING AND ACCESSORY STORAGE APPARATUS

The invention relates to a recycling and accessory storage apparatus for use crushing cans in small scale recycling and in storing hand held devices. The invention is directed particularly but not solely towards an apparatus for crushing cans and storing a portable vacuum cleaner, for use in the household or office.

BACKGROUND OF INVENTION

Recycling is an important issue affecting most local councils and consumers. Local councils have been forced through a lack of storage space and cost to introduce various recycling scheme such as separate movable bins for recycled and non recycled materials. However the same pressures also affect work environments and householders who are producing more and more refuse that needs to be sorted. Space in a household is more of a problem Space also affects the need to use various devices to keep areas clean and tidy. For example it is not possible to easily store a vacuum cleaner in a kitchen. Though cleaner devices are smaller, there is still a problem with storing or mounting these devices. Convenience is also an important consideration for encouraging cleaning, tidying and recycling.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

OBJECT OF THE INVENTION

It is an object of the invention to provide an improved recycling and accessory storage apparatus that ameliorates some of the disadvantages and limitations of the known art or at least provide the public with a useful choice.

SUMMARY OF INVENTION

In a first aspect the invention resides in an improved recycling and accessory storage apparatus for crushing items and storing accessory devices, the apparatus including a housing having apertures therein, wherein at least one of the apertures is formed as including a recess to allow the storage of an accessory therein and at least one other aperture is formed as including a recess and crushing means adapted to allow an item to be inserted, then crushed and ejected out of the apparatus.

Preferably, the storage aperture includes a body which is cantilevered from and within the housing to form a recess.

Preferably the housing defines an internal space therein including side walls and a front wall panel.

Preferably, the storage aperture includes a body which is shaped for at least a portion of portable vacuum cleaner.

Preferably, the other aperture recess comprises a curved passageway within the housing, to allow the item to be directed to be crushed and ejected therefrom.

Preferably, the crushing means includes opposing lever means having ends, forming a crushing throat space at one end adapted to accept the item to be crushed whereby one lever means is stationary while the other lever means can be rotated, to abut the item to be crushed against the stationary lever means to cause crushing.

Preferably, both lever means comprise a pair of bent arms, and the arms each have teeth attached to a jaw member located at the crushing throat space at the said one end wherein each arm forms a C-shape formed of straight sections.

Preferably, the housing has another aperture shaped and dimensioned for the storage of other accessories.

Preferably, the front wall is a curved front wall and the side walls are upright in orientation.

Preferably, the apparatus can have power activation means to activate any accessory that requires power both portable or mains.

Preferably the stationary lever means includes a foot plate extending from an aperture in the front wall to allow weight to be downwardly applied when crushing.

BRIEF DESCRIPTION

The invention will now be described, by way of example only, by reference to the accompanying drawings:

FIG. 1 is a perspective upper front view in accordance with a first preferred embodiment of the invention.

FIG. 2 is a rear upper perspective view in accordance with a first preferred embodiment of the invention.

FIG. 3 is another rear perspective upper view of the invention.

FIG. 4 is a rear perspective end view of the invention.

FIG. 5 is front end view of the invention.

FIG. 6 is top plan view of the invention.

FIG. 7 is a side view of one side of the apparatus, showing main internal parts.

FIG. 8 is a front end view showing the axis for a sectional view BB.

FIG. 9 is a sectional side view along axis BB.

FIG. 10 is front end view showing the position of axis for a sectional view CC.

FIG. 11 is a sectional side view along axis CC.

FIG. 12 is an upper perspective view of the crusher.

FIG. 13 is an exploded view of the crusher of FIG. 12.

FIG. 14 is a side elevation view of the crusher.

FIG. 15 is a rear elevation view of the crusher.

FIG. 16 is a top plan elevation view of the crusher.

FIGS. 17-21 are cross sectional side views of the apparatus being loaded with a can.

FIG. 17 is a side view showing a can being placed in front of the opening

FIG. 18 is a side view showing the can in the crushing throat.

FIG. 19 is a side view showing the can being crushed upon pedal being pressing down.

FIG. 20 is side view of the apparatus showing the can falling out of the jaws upon pedal release as shown by upwardly pointing arrow.

FIG. 21 shows the can finally exiting the assembly via ramp or plate and opening at the bottom.

DESCRIPTION OF DRAWINGS

The following description will describe the invention in relation to preferred embodiments of the invention, namely a recycling and accessory storage apparatus. The invention is in no way limited to these preferred embodiments as they are purely to exemplify the invention only and that possible variations and modifications would be readily apparent without departing from the scope of the invention.

A recycling and accessory storage apparatus 1 is shown in the FIGS. 1-21 having a modern shaped housing 2 adapted and constructed to provide a space 3 therein for a recycling means 4, and accessory/storage locating means 5 and 6. The recycling means 4 in this example is a can compressing or crushing means and the accessory storage/location means 5 is a vacuum locating means and accessory storage/locating means 6 is shaped and adapted to provide at least one holder for a variety of different handheld devices or tools such as scissors, knives and peelers or inserts for generic handles etc.

Figure 2:
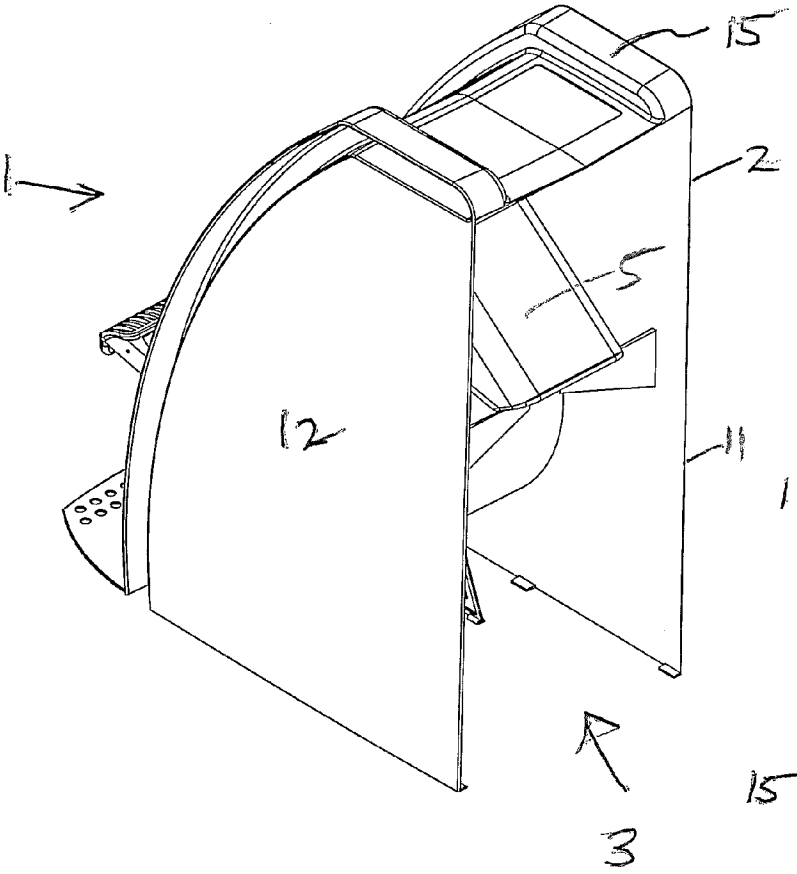
Figure 3:
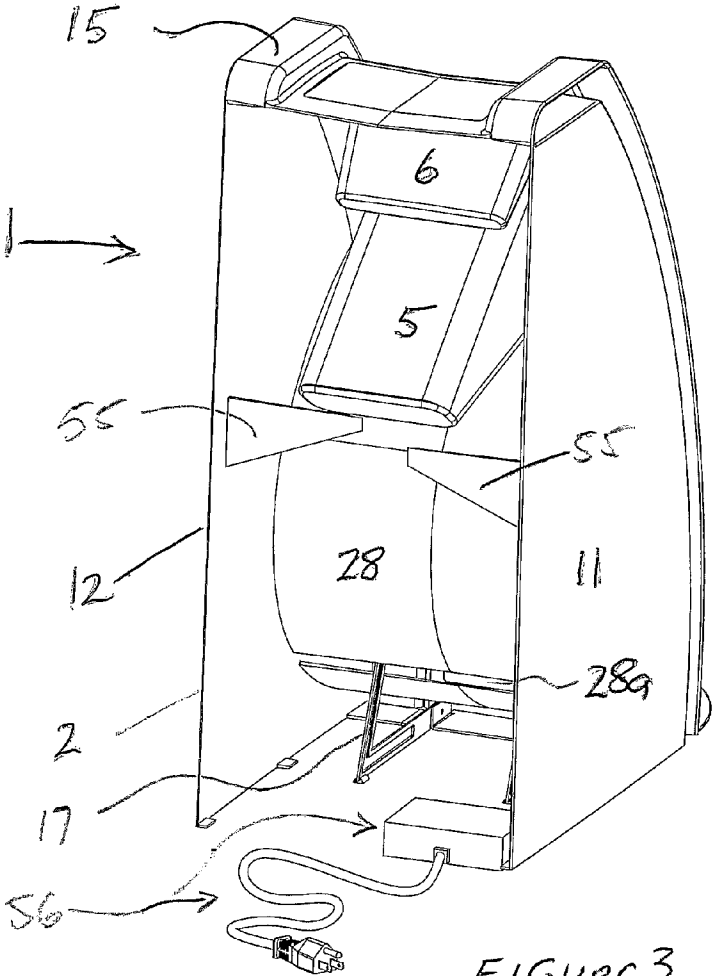

The housing 2 is shown being shaped having a front portion 10 which can be curved in the vertical plane and side portions 11 and 12 which are upright and planar. In this example front portion 10 as shown in FIGS. 2 and 3, is shown as being formed with the side portions 11 and 12 joined down the middle 14 with there being a rear facing enclosed area or space as seen in FIG. 2.

Front housing portion 10 has ribbed edges 15 with various apertures, recesses and means whereby the edges 15 function to provide strength and aesthetics. The crushing means 4 includes a first lever means 16 pivotally connected to a second lever means 17 which each have a portion which protrudes from and beyond the front portion 10 of housing 2 through a portion of a first aperture 18 leading into a recess but being an exit aperture. Crushing means 4 also has a second aperture 19 located above the first aperture 18 but linked to the first aperture 18, to provide an entrance for inserting items for crushing.

Figure 1:
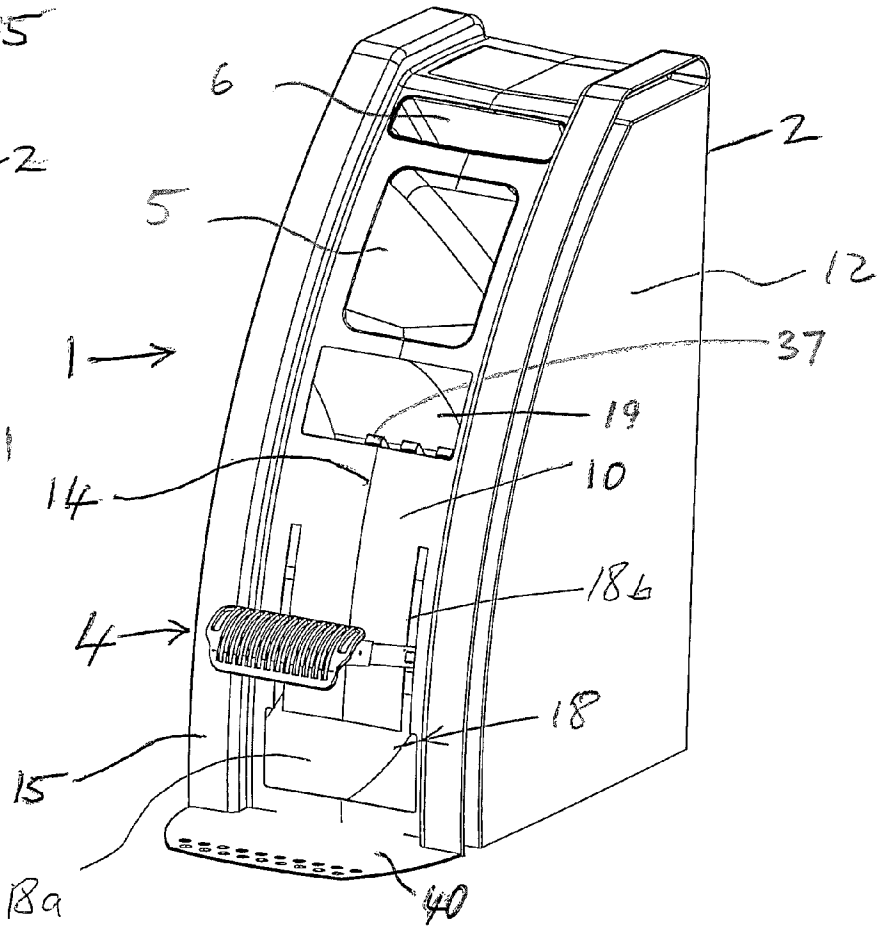

As shown in FIG. 1 first aperture 18 is square U-shaped formed by having a base aperture 18*a* in a rectangular shape with upright arm apertures 18*b* whereby the first lever means 16 operatively protrudes from the upright arm apertures 18*b* on each side whereas the base aperture 18*a* is more for the item being crushed to exit the apparatus after being crushed.

Figure 7:
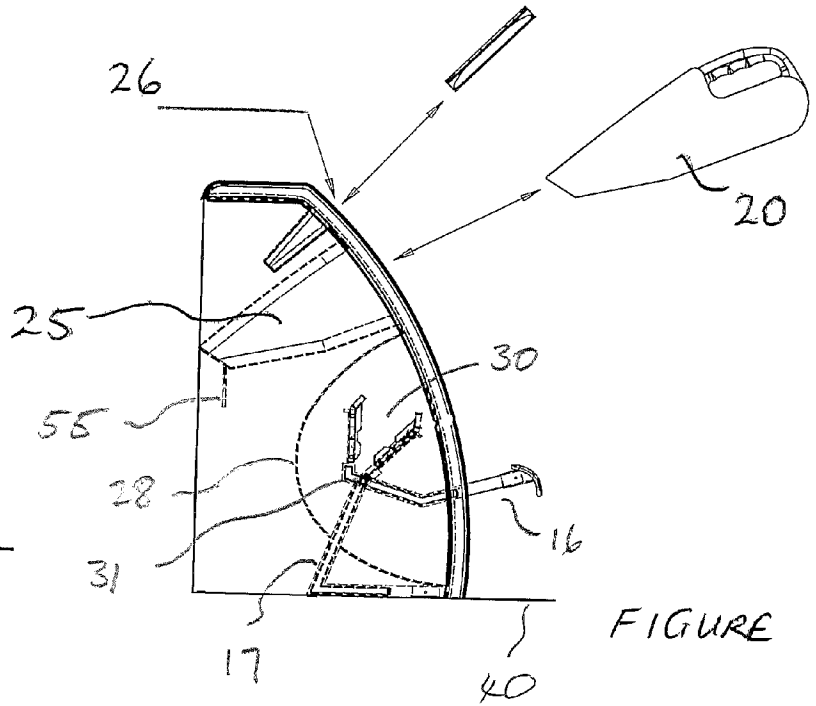
Figure 5:
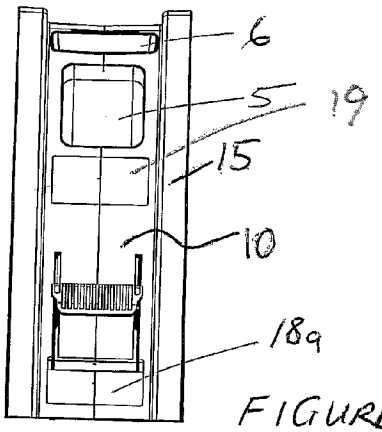
Figure 6:
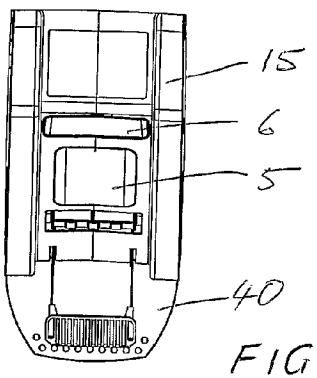
Figure 8:
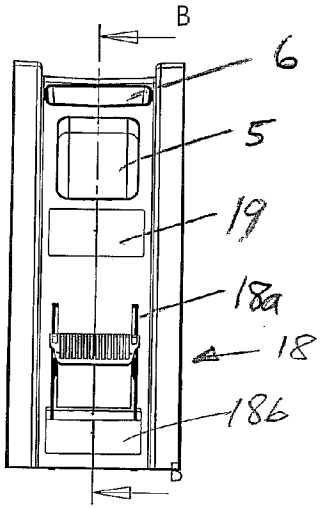

For example the item to be crushed can be at least one can 21. The crushing means 4 is generally located at the lower portion of the apparatus 1 so that the vacuum locating means 5 is situated above. Accessory locating means 5 includes a specially shaped recess called a first recess or pocket 25 being adapted to hold at least a portion of a vacuum cleaner 20. For example as shown in FIG. 7 a portable vacuum cleaner 20 can be located within the pocket 25. Pocket 25 can also include a charging port for the vacuum cleaner or any other suitable device. The recesses for accessory locating means 5 and 6 can be formed such that they cantilever from the front wall 10.

As shown in the figures above the accessory locating means 5 there can be a second recess 26 for the location of other accessories such as utensils and various tools.

As shown especially in FIGS. 7, 9, 11, 12 and 17-21 the crushing means 4 also includes the following components of a processing path 28 leading from an entrance in the form of the first aperture 19. This processing path 28 is shaped in a curved manner with a curved elongate base member to form a guiding track from a top to bottom apertures 19 to 18 which curves downwardly firstly to a can crushing position between first lever means 16 and second lever means 17, and then to base aperture 18*b* of the exit aperture 18. The can crushing position is more located at one end or at an upper end of the arms.

Figure 9:
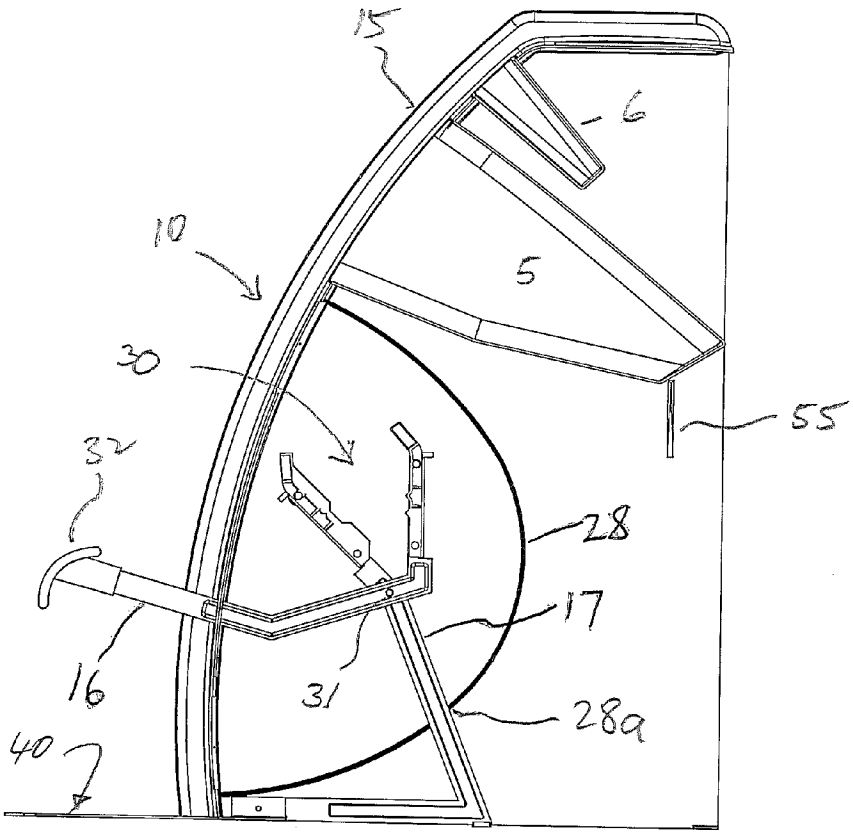
Figure 10:
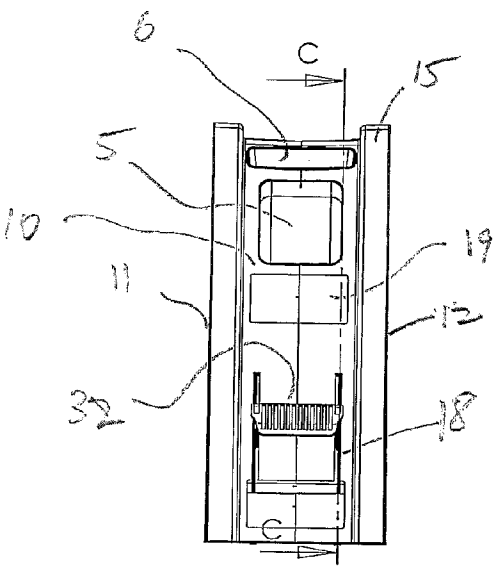
Figure 11:
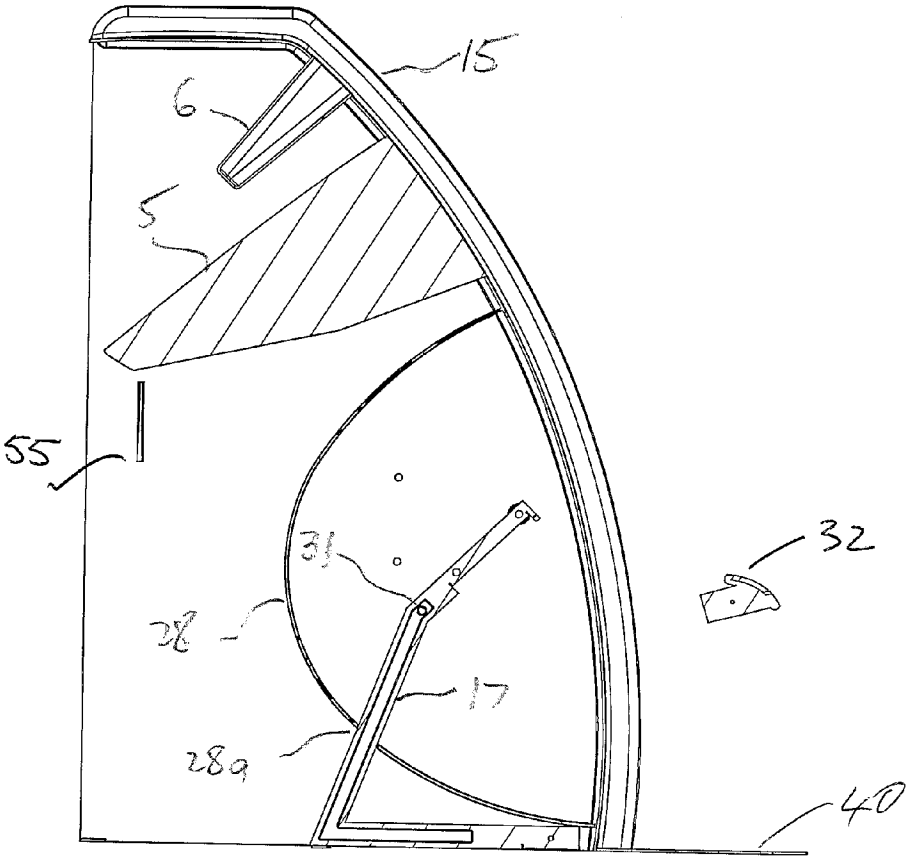

First lever means 16 is rotatably connected to second lever means 17 in an opposing type relationship as shown in FIG. 9 whereby a throat or space or crush zone 30 is formed there between to carry out the actual crushing. The space 30 is adapted in shape and dimensions to receive an item to be crushed and allow it to be crushed.

As shown in the figures each lever means 16 and 17 includes a pair of arms, overall shaped similarly as a C shape formed from straight sections. It is also possible to form the arms as straight sections or curved sections or in combination.

Second lever means 17 as seen in FIGS. 7 and 9 is supported by the ground or horizontal support and first lever means 16 movably mounted at pivot position 31 to second lever means 17. As shown in FIG. 3 the processing path 28 can extend from one side wall to the other. The overall curved shaped is almost continuous from top to bottom except for slit portion 28*b* (see FIG. 3) that allows a portion of the second lever means 17 to extend there through.

Figure 12:
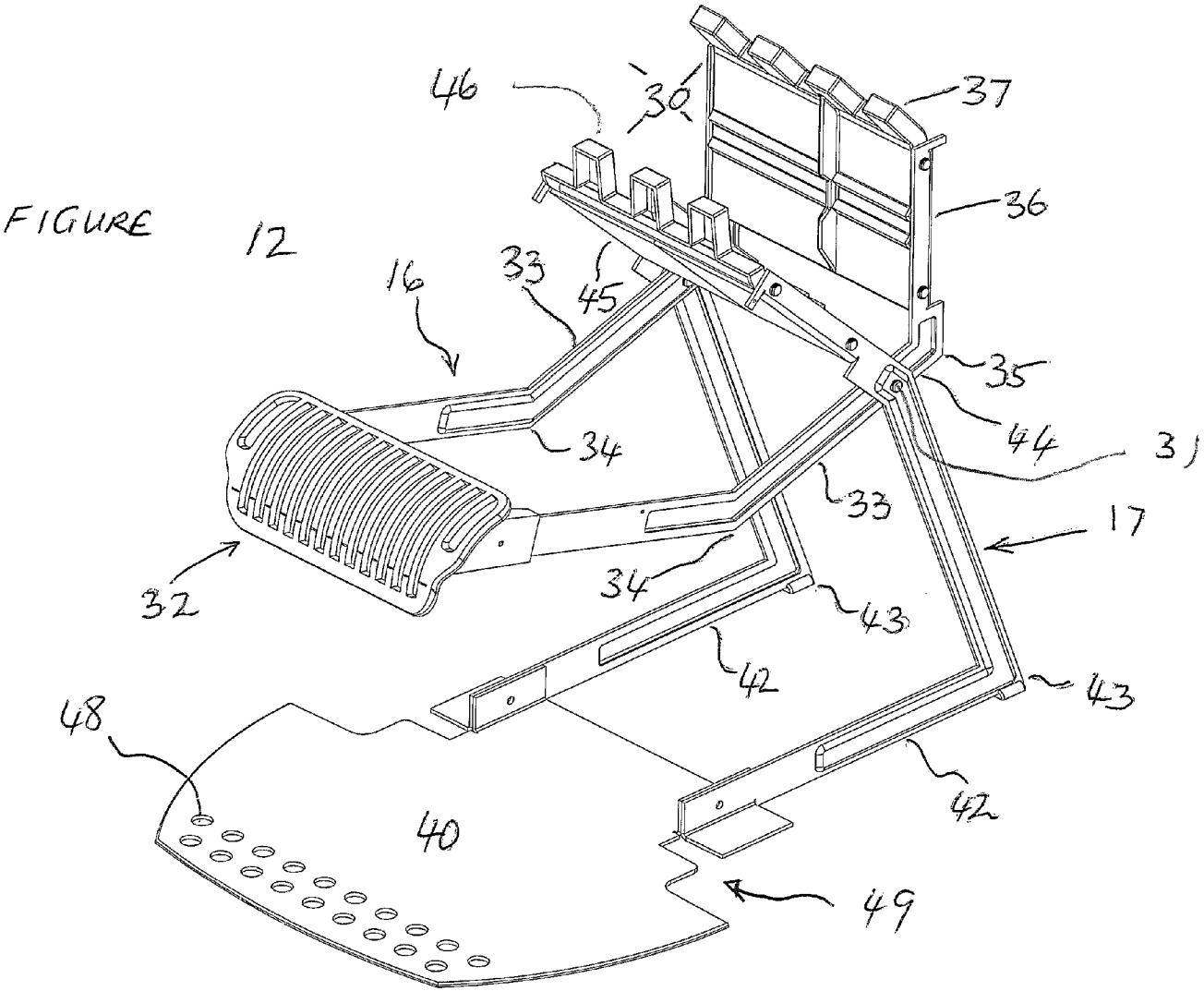
Figure 13:
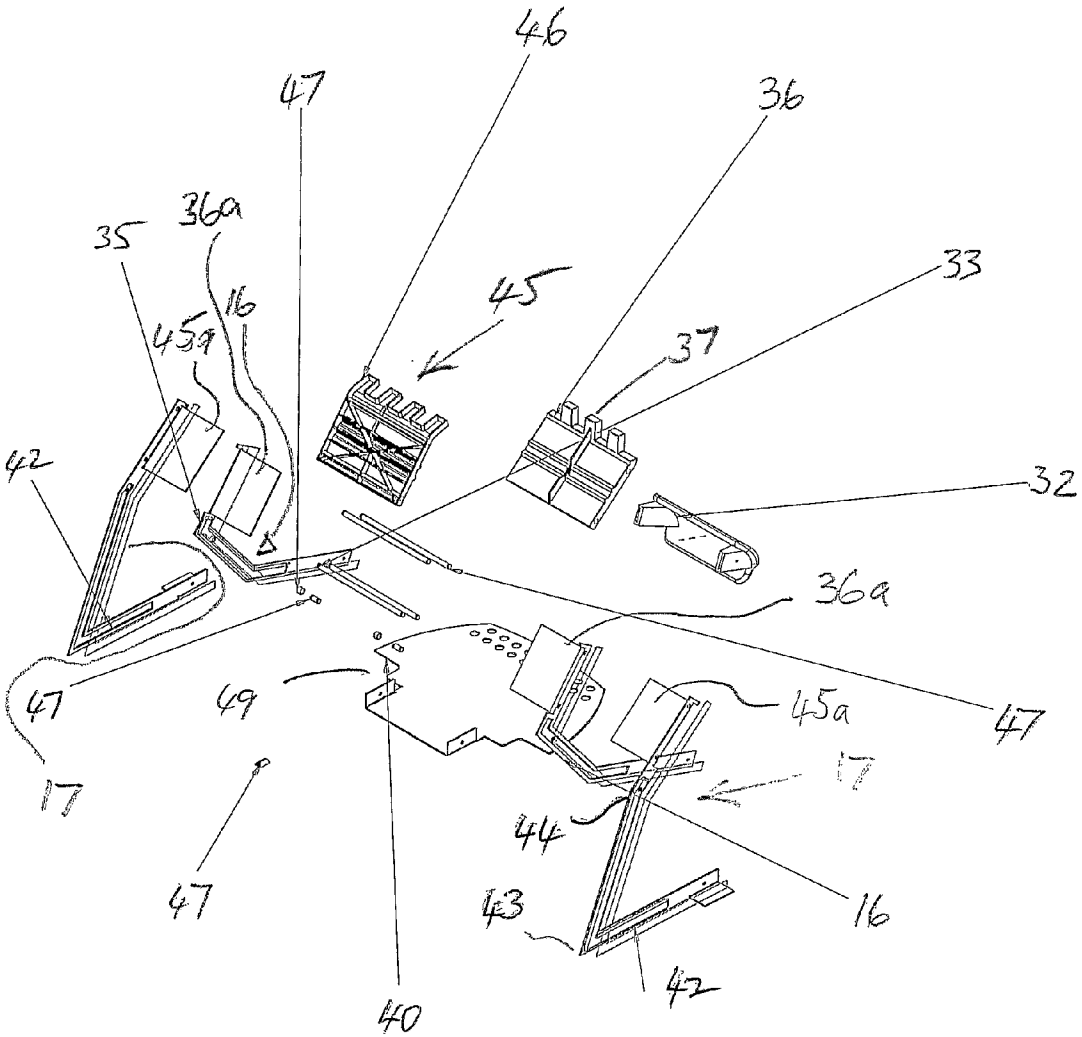
Figure 14:
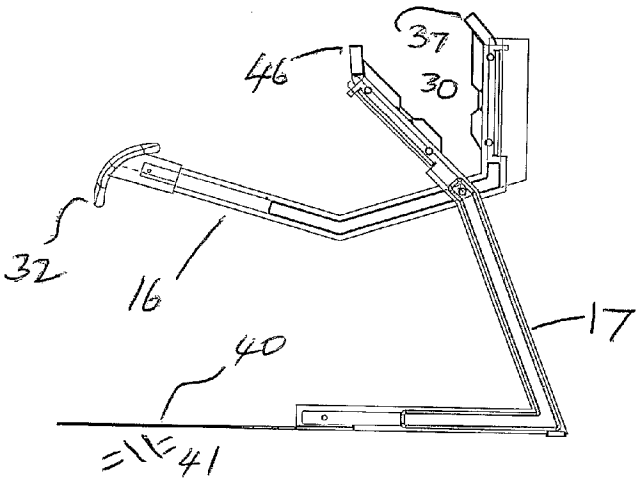
Figure 15:
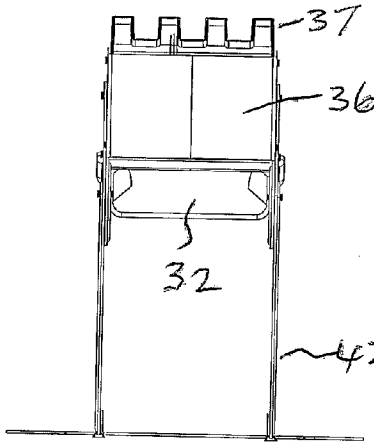
Figure 16:
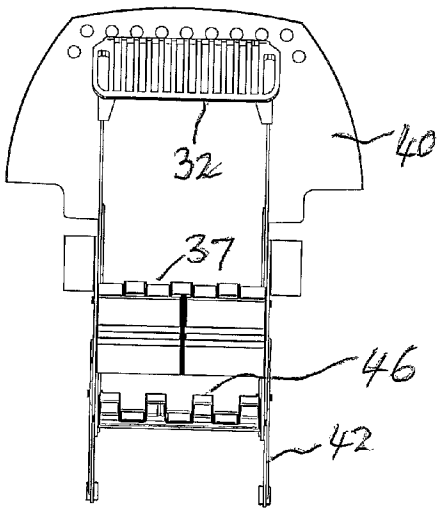

First lever means 16 as seen in FIG. 9 includes frame like arrangement comprising a pedal member 32 joined to or formed at one end of two parallel spaced second lever arms 33, pivoted about pivot point 31. At an end distal to the pedal 32 there is a first jaw member 36. First lever means 16 is generally formed whereby the arms 33 are bent in sections having a first elbow 34 leading to the pivot point 31. After the pivot point 31, the arms 33 bend upwardly again at a second elbow 35 to form one half of a first jaw portion. The first jaw portion comprises jaw member 36 with teeth 37 extending distally. The first jaw member 36 as shown in FIGS. 12 & 13 can include a rectangular shaped frame and/or plate 36*a* construction, extending across the space between the arms 33. As shown in FIG. 13 the plates 36*a* (and 45*a*) extend from both sides towards each other to protrude from the arms 16 and 17. Therefore as shown there can be four such plates in total for plates 36*a* and 45*a*.

Second lever means 17 also includes a rectangular frame-like arrangement comprising a bottom plate or ramp 40 being supported by a horizontal support like a floor 41, with plate 40 being attached at one end of two arms 42. The arms 42 are firstly bent forming a third elbow 43 which lead to pivot point 31. After pivot point 31, the arms 42 are bent a second time at elbow 44 leading to a second jaw member 45. The second jaw member 45 comprises a plate 45*a* and/or jaw frame with teeth 46 extending distally also extending between the arms 42. The first and second jaw members 36 and 45 together operationally form the throat or crushing zone 30.

The components of the crushing means 4 are shown in an exploded view of FIG. 13. The frame of the arms can be formed from folded steel and the other components from a plastic. FIGS. 17-21 show a can for example which is inserted into the second aperture 19 leading into the throat space 30 between the first and second jaw portions. Other components like pins 47 and mounting are also shown in FIG. 13. The foot plate can be shaped as being wide enough to allow a foot to hold the lever 17 down but include apertures 48 and/or roughed means thereon. Plate 40 can be necked 49 to allow it to be attached to the lever 14.

Operation—See FIGS. 17-21

As shown in FIGS. 17-21 a can 21 is shown with various arrows to indication direction of movement. To initiate crushing or compressing, pedal 32 of lever means 16 is pushed down using a persons feet (see FIGS. 17, 18) which causes the first lever means 16 to rotate about pivot point 31, downwardly at 50 (see FIG. 19) whereby the first jaw portion moves towards the stationary second jaw portion 17 to crush the can 21 to form a can 21*a*—see FIGS. 20 & 21.

After crushing, as in FIG. 20 the first lever means 16 moves back up (automatically using a biasing means such as a spring—not shown) to allow the resulting crushed can to drop back onto path 28 and fall out or be ejected out of the first aperture 18. When the pedal 32 is released it goes up as seen in FIG. 20 thereby releasing the crushed can 21*a*.

Figure 4:
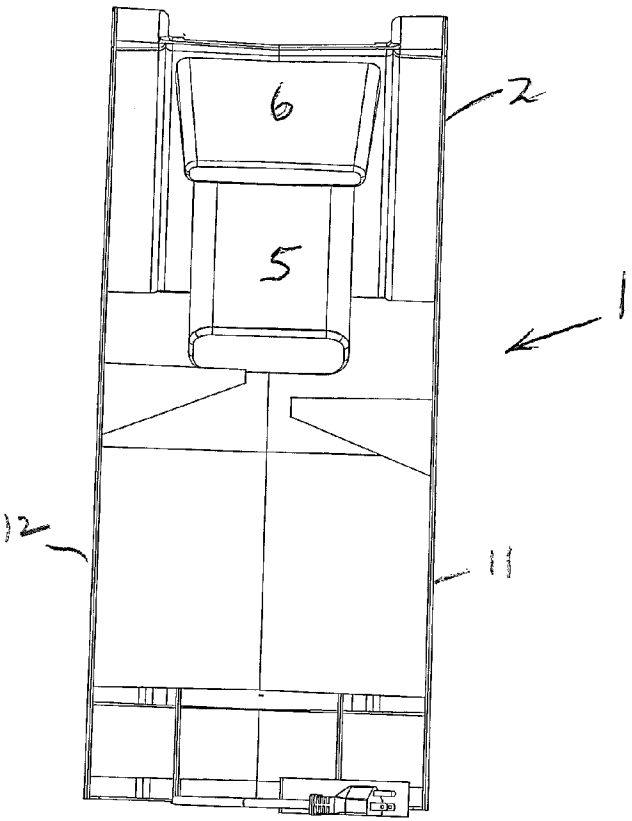

Accessory locating means 5 and 6 are shown in FIGS. 3 and 4 as being formed of a polygonal shaped tubular member which can be rear supported by cantilevered wall brackets 55.

The tubular member is also generally formed to cantilever from the front face 10 of the apparatus. Also shown in FIG. 3 the apparatus 1 includes power activation means 56, which is adapted to charge the vacuum cleaner charging port, is connected to any power point outlet which can be mains sourced or portable like batteries.

ADVANTAGES a) Modern looking
b) Convenient
c) Efficient use of space
d) Reduces waste
e) Simple to manufacture
f) Easy to use

VARIATIONS

Throughout the description of this specification, the word "comprise" and variations of that word such as "comprising" and "comprises", are not intended to exclude other additives, components, integers or steps.

The housing 2 though shown having only sides and a curved front can also be formed having a different shape as required and can also have a base and rear panel if necessary or desired. The sides are shown as being formed with the front portion and portions of the crushing and vacuum locating means though these can be formed separately and simply fitted together. The housing can be formed as part of other cabinetry or structures.

Also though the apparatus housing is shown as one piece it can be formed as conveniently as required such by moulding in halves. Other forms of recycling means 4 other than crushing cans, are crushing any other types of materials such as plastic bottles for example. The apparatus can be formed as a portable apparatus that can easily be fitted in combination with other furniture or it can be stand alone. Depending on the volume and size of items to be recycled or stored, will determine either how many apparatus and what their size is.

All of the apertures though shown as being rectangular or square U-shaped can be formed of other shapes as desired. This will depend on what is being crushed or compressed or what is being stored.

The vacuum recess 19 can be shaped to fit any shaped vacuum cleaner. The pocket 25 can be recessed or can be apertured. A base along the bottom of the pocket is not entirely necessary to hold the vacuum cleaner in place. The same applies to the second recess 26 which can be simply a recess or be apertured It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

It will also be understood that where a product, method or process as herein described or claimed and that is sold incomplete, as individual components, or as a "kit of Parts", that such exploitation will fall within the ambit of the invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

What I claim is:

1. A recycling and accessory storage apparatus for crushing items and storing accessory devices, the storage apparatus comprising:

a housing defining an internal space therein and including side walls, a front wall panel, a base member forming a processing path for an item to be crushed, and a floor together forming the internal space therebetween, the housing having apertures therein, at least one of the apertures including a recess to allow storage of an accessory therein and at least one other aperture including a recess and crushing means configured to allow the item to be inserted, then crushed and ejected out of the storage apparatus, the crushing means including opposing lever means having ends forming a crushing throat space at one end adapted to accept the item to be crushed, one lever means being stationary and the other lever means being rotatable to abut the item to be crushed against the stationary lever means to cause crushing, wherein the base member includes an aperture through which the stationary lever means extends, the stationary lever means being held down by the floor to enable the stationary lever means to be stationary.

2. The recycling and accessory storage apparatus as claimed in claim 1 wherein the storage aperture includes a body which is cantilevered from and within the housing to form a recess.

3. The recycling and accessory storage apparatus as claimed in claim 2 wherein, the storage aperture includes a body which is shaped for at least a portion of portable vacuum cleaner.

4. The recycling and accessory storage apparatus as claimed in claim 3 wherein, the other aperture recess comprises a curved passageway within the housing, to allow the item to be directed to be crushed and ejected therefrom.

5. The recycling and accessory storage apparatus as claimed in claim 1, wherein both lever means comprise a pair of bent arms, and the arms each have teeth attached to a jaw member located at the crushing throat space at the said one end wherein each arm forms a C-shape formed of straight sections.

6. The recycling and accessory storage apparatus as claimed in claim 5 wherein, the housing has another aperture shaped and dimensioned for the storage of other accessories.

7. The recycling and accessory storage apparatus as claimed in claim 6 wherein, the front wall is a curved front wall and the side walls are upright in orientation.

8. The recycling and accessory storage apparatus as claimed in claim 7 wherein, the apparatus can have power activation means to activate any accessory that requires power both portable or mains.

9. The recycling and accessory storage apparatus as claimed in claim 8 wherein the stationary lever means includes a foot plate extending from an aperture in the front wall to allow weight to be downwardly applied when crushing.

10. A recycling and accessory storage apparatus for crushing items and storing accessory devices, the storage apparatus comprising:

a housing having apertures therein, at least one of the apertures including a recess to allow storage of an accessory therein, and at least one other aperture including a recess and crushing means adapted to allow an item to be inserted, then crushed and ejected out of the apparatus, the crushing means including opposing lever means having ends, a crushing throat space formed at one end and configured to accept the item to be crushed, one lever means being stationary while the other lever means can be rotated, to abut the item to be crushed against the stationary lever means to cause crushing.

11. A recycling and accessory storage apparatus for crushing items and storing accessory devices, the storage apparatus comprising:

a housing defining an internal space therein and including side walls, a front wall panel, a base member forming a processing path for an item to be crushed, and a floor together forming the internal space therebetween, the housing having apertures therein, at least one of the apertures including a recess to allow storage of an accessory therein and at least one other aperture including a recess and a crushing device configured to allow the item to be inserted, then crushed and ejected out of the storage apparatus, the crushing device including opposing levers having ends forming a crushing throat space at one end adapted to accept the item to be crushed, one lever being stationary and the other lever being rotatable to abut the item to be crushed against the stationary lever to cause crushing, wherein the base member includes an aperture through which the stationary lever passes and is thereafter held down by the floor to enable the stationary lever to be stationary.

* * * * *